US005263420A

United States Patent [19]

Schwendt et al.

[11] Patent Number: 5,263,420

[45] Date of Patent: Nov. 23, 1993

[54] RADIAL CONTROL THREE AXLE RUNNING GEAR FOR RAIL VEHICLES

[75] Inventors: Lutz Schwendt, Vellmar; Martin Lipsius; Wolfgang Auer, both of Kassel, all of Fed. Rep. of Germany

[73] Assignee: ABB Henschel Lokomotiven GmbH, Mannheim, Fed. Rep. of Germany

[21] Appl. No.: 986,850

[22] Filed: Dec. 4, 1992

[30] Foreign Application Priority Data

Dec. 5, 1991 [DE] Fed. Rep. of Germany ..... 4140126

[51] Int. Cl.[5] ..... B61F 5/38

[52] U.S. Cl. ..... 105/166; 105/168

[58] Field of Search ..... 105/166, 167, 168, 196, 105/218.2

[56] References Cited

U.S. PATENT DOCUMENTS

| | | | |
|---|---|---|---|
| 1,408,167 | 2/1922 | Brilhart | 105/166 X |
| 1,417,135 | 5/1922 | Brilhart | 105/166 X |
| 2,792,791 | 5/1957 | Kreissig | 105/168 X |
| 4,542,700 | 9/1985 | Smith | 105/166 |
| 4,660,476 | 4/1987 | Franz | 105/168 |
| 4,679,507 | 7/1987 | Rassaian | 105/168 X |

*Primary Examiner*—Robert J. Oberleitner
*Assistant Examiner*—S. Joseph Morano
*Attorney, Agent, or Firm*—Herbert L. Lerner; Laurence A. Greenberg

[57] ABSTRACT

A running gear for rail vehicles includes a bogey, truck or vehicle frame. Three driven wheelsets are elastically supported in the frame. Longitudinal guide rods extend parallel to the longitudinal center of the vehicle for coupling rotary motions about vertical axes of the first and third wheelsets with a transverse motion of the second wheelset upon traversing curves. Each of the guide rods have first ends being pivotably secured to a bearing housing of a respective one of the first and third wheelsets and second ends pointing away from the respective bearing housing and toward the second wheelset. Bell cranks are supported on the outside of the frame and have two diagonally opposed pairs of arms pointing toward the longitudinal center of the vehicle and two diagonally opposed pairs of arms pointing toward the second wheelset. The second ends of the connecting rods are each pivotably secured to a respective one of the arms pointing toward the longitudinal center of the vehicle. Transversely extending coupling rods are each pivotably connected to a respective two of the arms pointing toward the second wheelset. Double levers are supported on the outside of the frame and extend in the longitudinal direction of the vehicle. Each of the double levers pivotably connect one of the arms of one of the diagonally opposed pair of arms pointing toward the second wheelset to the an surface of one of the bearing housings of the second wheelset.

1 Claim, 3 Drawing Sheets

(A)

RADIAL CONTROL THREE AXLE RUNNING GEAR FOR RAIL VEHICLES

The invention relates to a running gear for rail vehicles having three driven wheelsets being elastically supported in a bogey, truck or vehicle frame, in which rotary motions of the first wheelset and the third wheelset being established upon traveling curves are coupled about vertical axes with the transverse motion of the second wheelset guided by longitudinal guide rods.

One such running gear is known from Published European Application No. 0 094 548. There, the three wheelsets supported in the vehicle frame are provided with claw suspension drives. A housing of the claw suspension drive of the middle wheelset is pivotably connected to the housings of the claw suspension drives of the leading wheelset and trailing wheelset through transversely extending connecting rods. The middle wheelset is guided in the transverse direction through guide rods being located in the longitudinal direction of the vehicle and engaging the two wheelset bearing housings. The housings of the claw suspension drives of the leading axle are each connected to the vehicle frame through a connecting rod located in the longitudinal center of the vehicle. With such a coupling of the three wheelsets among one another and with the vehicle frame, the radial self-adjustment of the leading wheelset and the trailing wheelset that ensues for known reasons when riding around curves necessarily leads to a lateral displacement of the middle wheelset in the direction of the rail located on the outside of the curve of the track, and thus the middle wheelset is also involved in the transmission of forces acting radially to the curve of the track.

It is considered disadvantageous in the aforementioned running gear for rail vehicles, that its applicability to running gears with claw suspension drives is limited.

It is accordingly an object of the invention to provide a running gear for rail vehicles, which overcomes the hereinafore-mentioned disadvantages of the heretofore-known devices of this general type and which does so in such a way that lateral displacement, and therefore radial carrying along of the middle wheelset, is possible not only with a claw suspension drive but also with an undercarriage drive.

With the foregoing and other objects in view there is provided, in accordance with the invention, a running gear for rail vehicles, comprising a bogey, truck or vehicle frame having an outside and defining a longitudinal center of the vehicle; first, second and third driven wheelsets being elastically supported in the frame, the wheelsets including bearings having housings with end surfaces; longitudinal guide rods extending parallel to the longitudinal center of the vehicle for coupling rotary motions about vertical axes of the first and third wheelsets with a transverse motion of the second wheelset upon traversing curves, each of the guide rods having first ends being pivotably secured to the bearing housing of a respective one of the first and third wheelsets and second ends pointing away from the respective bearing housing and toward the second wheelset; bell cranks being supported on the outside of the frame and having two diagonally opposed pairs of arms pointing toward the longitudinal center of the vehicle and two diagonally opposed pairs of arms pointing toward the second wheelset; the second ends of the connecting rods each being pivotably secured to a respective one of the arms pointing toward the longitudinal center of the vehicle; transversely extending coupling rods each being pivotably connected to a respective two of the arms pointing toward the second wheelset; and double levers being supported on the outside of the frame and extending in the longitudinal direction of the vehicle, each of the double levers pivotably connecting one of the arms of one of the diagonally opposed pair of arms pointing toward the second wheelset to the end surface of one of the bearing housings of the second wheelset.

The advantages attained with the invention are in particular that regardless of the type of drive being used (claw suspension drive or undercarriage drive), the elements provided for coupling the rotary motions of the first and third wheelsets about vertical axes with the transverse displacement of the second wheelset, engage only the wheelset bearing housings of the three wheelsets disposed in the running gear, and that aside from the two coupling rods extending transversely between the bell cranks, no further coupling elements contact the interior of the bogey or truck frame or vehicle frame. Besides being suitable for claw suspension drives or undercarriage drives, the invention is also suitable for rail vehicle drives in which bogies are present and the drive motors are suspended completely or partially from the vehicle frame.

Other features which are considered as characteristic for the invention are set forth in the appended claims.

Although the invention is illustrated and described herein as embodied in a running gear for rail vehicles, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
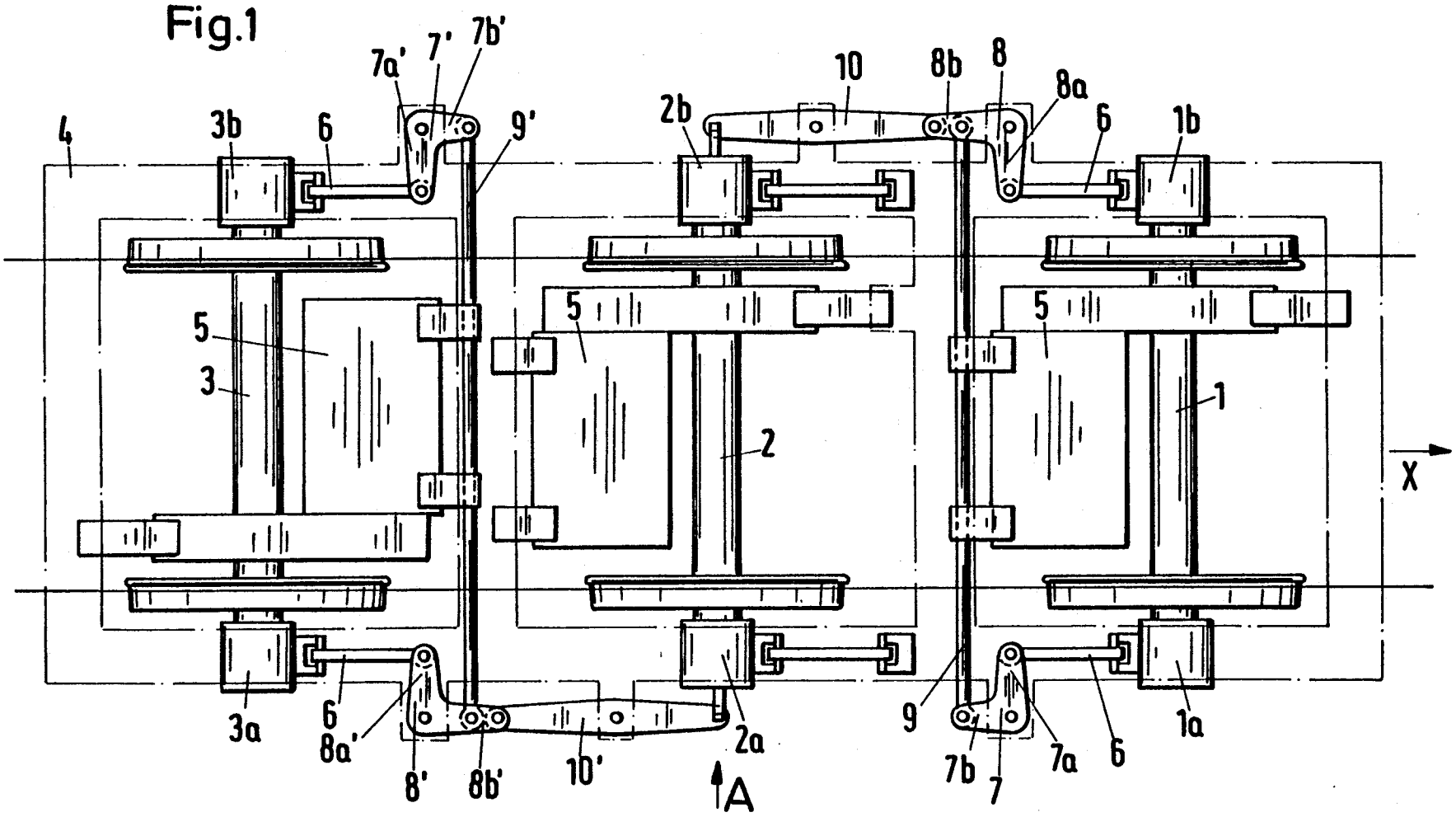
FIG. 1 is a diagrammatic, top-plan view of a running gear for rail vehicles, with three driven wheelsets in the "straight-ahead" position.

Referring now to the figures of the drawing in detail and first, particularly, to FIG. 1 thereof, there is seen a running gear for rail vehicles that is shown from above in the "straight-ahead" position, in which wheelsets 1, 2 and 3 are elastically supported in a known manner in a bogey, truck or vehicle frame 4. The bogey, truck or vehicle frame 4 is shown in phantom lines. Each of the wheelsets 1, 2 and 3, which are also referred to below as first, second and third wheelsets, respectively, is provided with an undercarriage drive 5 in the exemplary embodiment. Instead of the undercarriage drive 5, non-illustrated claw suspension drives may also be used. The undercarriage drives 5 are secured in a known manner to the bogey, truck or vehicle frame 4. The wheelsets 1 and 3, which are also called "end wheelsets", are guided by guide rods 6 that have first ends which are pivotably secured to housings of bearings 1*a*, 1*b* of the wheelset and extend parallel to the longitudinal center line of the vehicle. Bell cranks 7, 7', 8, 8' are diagonally offset on the outside of the bogey, truck or vehicle frame 4. Second ends of the guide rods 6 facing away from the housings of the wheelset bearings 1*a*, 1*b* are pivotably secured to arms 7*a*, 7*a*', 8*a*, 8*a*' of the bell cranks 7, 7', 8, 8', which face toward the longitudinal center line of the vehicle. Transversely extending coupling rods 9, 9' are pivotably secured to arms 7*b*, 7*b*', 8*b*, 8*b*' of the bell cranks 7, 7' and 8, 8', which face toward the second or middle wheelset 2.

The arms 8*b*, 8*b*' of the two bell cranks 8, 8' that are disposed diagonally offset on the outside of the bogey, truck or vehicle frame 4, are lengthened in the direction toward the second wheelset 2 and extend beyond the pivot point of the coupling rods 9, 9'. Double cranks 10, 10' are pivotably supported about vertical axes on the outside of the corresponding long side of the bogey, truck or vehicle frame 4. A free end of each of the two arms 8*b*, 8*b*' is pivotably connected through a respective one of the double cranks 10, 10' with an end surface of a corresponding housing of wheelset bearings 2*a*, 2*b* of the second wheelset 2. The double cranks or levers 10 and 10' extend in the longitudinal vehicle direction.

Figure 2:
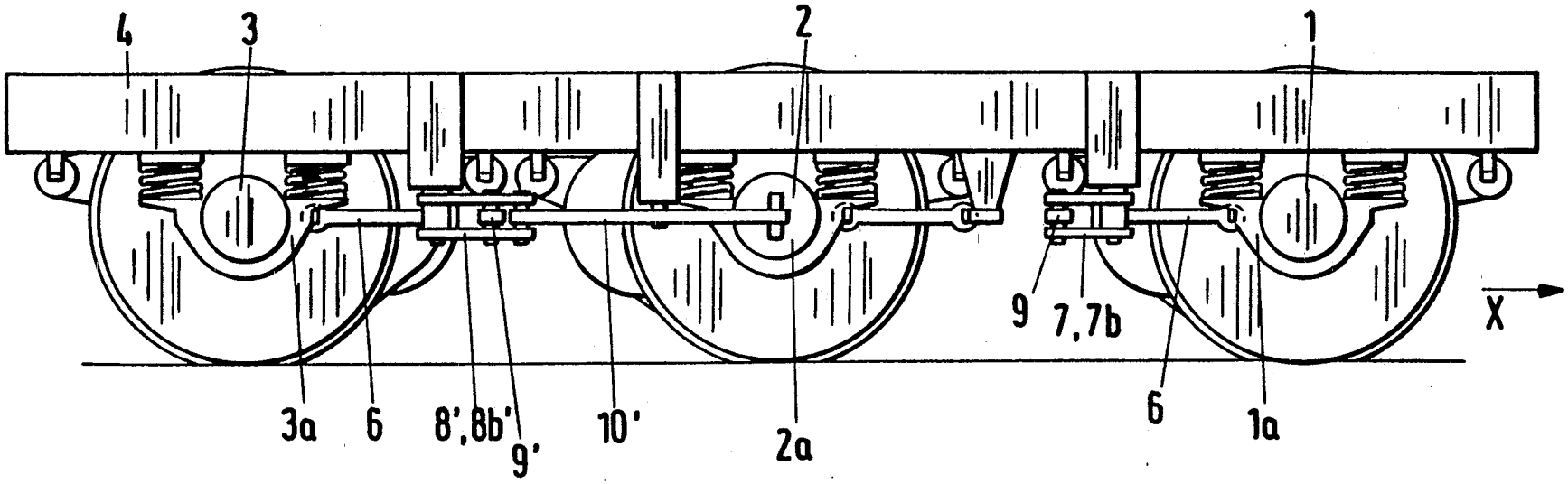
FIG. 2 is a side-elevational view of the running gear, as seen in the direction A of FIG. 1.

In the running gear of FIG. 1, which is shown in a side view in FIG. 2, the guide rods 6, the bell cranks 7 and 8, and the double levers 10' (seen in FIG. 2), are located at approximately the height of the center of the wheelsets.

Figure 3:
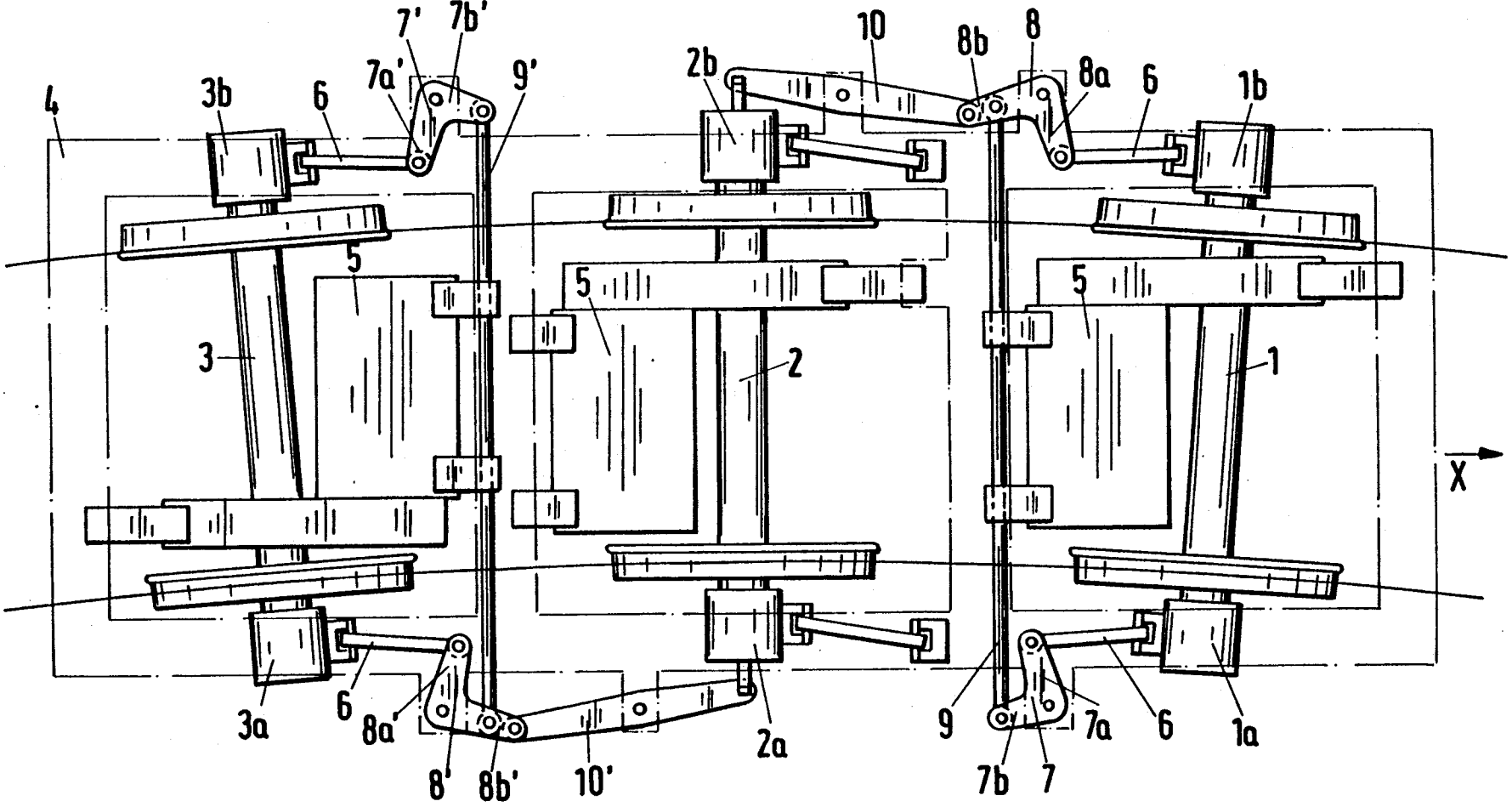
FIG. 3 is a top-plan view of the running gear of FIG. 1, in the "curve travel" position.

In the "curve travel" position shown in FIG. 3, a curve of a track, which is not identified by a reference numeral, has been shown in an exaggeratedly narrow representation, for the sake of clarity. As a result, the angular position of the wheelsets 1 and 3 is correspondingly exaggeratedly large.

During curve travel in the travel direction indicated by an arrow X and pointing to the right in FIG. 3, a difference arises in the size of the rolling radii between the inner and outer wheels, because of the conicity of the wheel profile, and the result is that steering forces arise between the wheel and the rail that tend to adjust the leading wheelset 1 and the trailing wheelset 3 radially relative to the track curve. The wheelset bearing 1*a* of the wheelset 1 that is located on the right as seen along this travel direction X exerts a pressing force, through the pivotably connected guide rod 6, against the arm 7*a* of the bell crank 7 facing toward the longitudinal center of the vehicle. At the same time, the wheelset bearing 1*b* of the wheelset 1 located on the left as seen along this travel direction X exerts a pulling force, through the connecting rod 6 pivotably connected to it, on the arm 8*a* of the bell crank 8 pointing toward the longitudinal center of the vehicle. The resultant motions of the arms 7*b* and 8*b* of the bell cranks 7 and 8 which act in the same direction, are joined to one another by means of the coupling rod 9 extending transversely and being pivotably attached to the arms 7*b* and 8*b*. A portion of the aforementioned steering forces resulting from the radial self-adjustment of the wheelset 1 acts through the double lever 10 engaging the lengthened free end of the arm 8*b* of the bell crank 8, to pull the wheelset bearing 2*b* of the middle wheelset 2, which located on the left as seen in this travel direction X, to the left, and thus to press the middle wheelset 2 against the outer rail of the track curve.

With the coupling linkage explained above, the middle wheelset 2 is moved in the direction of the outer rail of the track curves by both the leading wheelset 1 and the trailing wheelset 3 as it travels on curves. The middle wheelset 3 can accordingly absorb a portion of the centrifugal force in the curve and can decrease the guiding force of the guiding leading wheelset 1.

We claim:

1. A running gear for rail vehicles, comprising:

a frame having an outside and defining a longitudinal center of the vehicle;

first, second and third driven wheelsets being elastically supported in said frame, said wheelsets including bearings having housings with end surfaces;

longitudinal guide rods extending parallel to the longitudinal center of the vehicle for coupling rotary motions about vertical axes of said first and third wheelsets with a transverse motion of said second wheelset upon traversing curves, each of said guide rods having first ends being pivotably secured to said bearing housing of a respective one of said first and third wheelsets and second ends pointing away from said respective bearing housing and toward said second wheelset;

bell cranks being supported on the outside of said frame and having two diagonally opposed pairs of arms pointing toward the longitudinal center of the vehicle and two diagonally opposed pairs of arms pointing toward said second wheelset;

said second ends of said connecting rods each being pivotably secured to a respective one of said arms pointing toward the longitudinal center of the vehicle;

transversely extending coupling rods each being pivotably connected to a respective two of said arms pointing toward said second wheelset; and double levers being supported on the outside of said frame and extending in the longitudinal direction of the vehicle, each of said double levers pivotably connecting one of said arms of one of said diagonally opposed pair of arms pointing toward said second wheelset to said end surface of one of said bearing housings of said second wheelset.

* * * * *